US009682263B2

(12) United States Patent
Kadoche

(10) Patent No.: US 9,682,263 B2
(45) Date of Patent: Jun. 20, 2017

(54) SPRINKLER COMPRISING A MEMBER HELD BY A FUSIBLE MEMBER AND EJECTION MEANS ACTING IN A PULLING SENSE ON THE MEMBER

(71) Applicants: VACTEC, Saint Florent sur Cher (FR); Maurice Kadoche, Coubron (FR)

(72) Inventor: Maurice Kadoche, Coubron (FR)

(73) Assignees: VACTEC, Saint Florent sur Cher (FR); Maurice Kadoche, Coubron (FR)

( * ) Notice: Subject to any disclaimer, the term of this patent is extended or adjusted under 35 U.S.C. 154(b) by 26 days.

(21) Appl. No.: 14/769,705

(22) PCT Filed: Feb. 13, 2014

(86) PCT No.: PCT/FR2014/050283

§ 371 (c)(1),
(2) Date: Aug. 21, 2015

(87) PCT Pub. No.: WO2014/128386

PCT Pub. Date: Aug. 28, 2014

(65) Prior Publication Data

US 2016/0008642 A1 Jan. 14, 2016

(30) Foreign Application Priority Data

Feb. 21, 2013 (FR) ..... 13 51517

(51) Int. Cl.
*A62C 35/62* (2006.01)
*A62C 35/68* (2006.01)
(Continued)

(52) U.S. Cl.
CPC ..... *A62C 37/12* (2013.01); *A62C 35/62* (2013.01); *A62C 35/68* (2013.01); *A62C 37/14* (2013.01)

(58) Field of Classification Search
CPC ..... A62C 35/62; A62C 35/68; A62C 37/12; A62C 37/14
See application file for complete search history.

(56) References Cited

U.S. PATENT DOCUMENTS 590,978 A * 10/1897 Gschwind ..... A62C 37/10 169/41
758,522 A 4/1904 Garrett
(Continued)

FOREIGN PATENT DOCUMENTS

| | | |
|---|---|---|
| DE | 2703459 A1 | 8/1977 |
| DE | 3225798 A1 | 1/1984 |
| WO | 0230516 A1 | 4/2002 |

OTHER PUBLICATIONS

International Search Report dated Aug. 22, 2014 for corresponding International Application No. PCT/FR2014/050283, filed Feb. 13, 2014.

(Continued)

*Primary Examiner* — Ryan Reis
(74) *Attorney, Agent, or Firm* — David D. Brush; Westman, Champlin & Koelher, P.A.

(57) ABSTRACT

A sprinkler includes: a fixing connector, which allows the sprinkler to be connected to pipework and has a nozzle; a fusible member; a shutoff member for shutting off the nozzle, held in shutoff position by the fusible member; and an ejecting element for ejecting the shutoff member. The ejecting element is mounted outside the duct and acts in a pulling sense on the shutoff member.

5 Claims, 2 Drawing Sheets

(51) Int. Cl.
*A62C 37/12* (2006.01)
*A62C 37/14* (2006.01)

(56) References Cited

U.S. PATENT DOCUMENTS

| | | | | | |
|---|---|---|---|---|---|
| 777,783 | A * | 12/1904 | Garrett | A62C 37/12 | 169/39 |
| 4,108,247 | A * | 8/1978 | Mohler | A62C 37/14 | 169/38 |
| 4,880,063 | A * | 11/1989 | Leininger | A62C 37/12 | 169/37 |
| 6,715,561 | B2 * | 4/2004 | Franson | A62C 35/62 | 169/16 |
| 6,854,668 | B2 * | 2/2005 | Wancho | B05B 1/265 | 169/37 |
| 7,516,800 | B1 * | 4/2009 | Silva, Jr. | A62C 35/68 | 169/17 |

OTHER PUBLICATIONS

English translation of the Written Opinion dated Aug. 21, 2015 for corresponding International Application No. PCT/FR2014/050283, filed Feb. 13, 2014.

* cited by examiner

Fig. 1
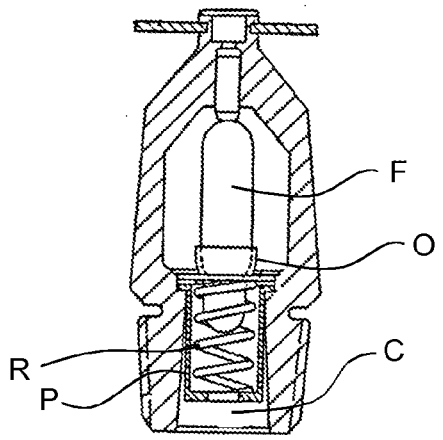
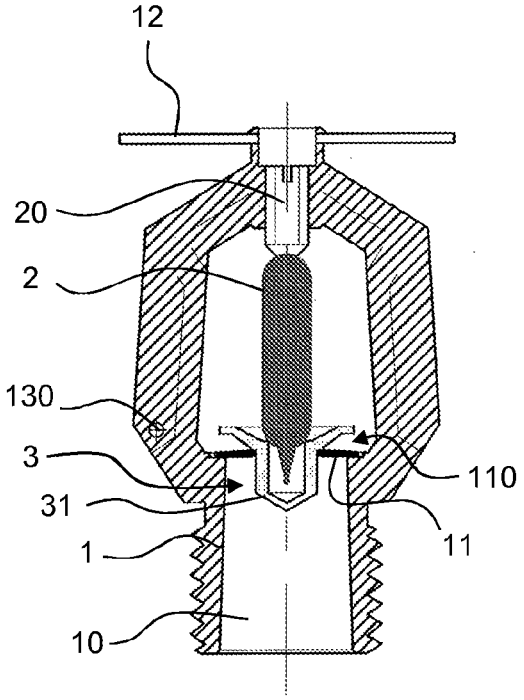
Fig. 2
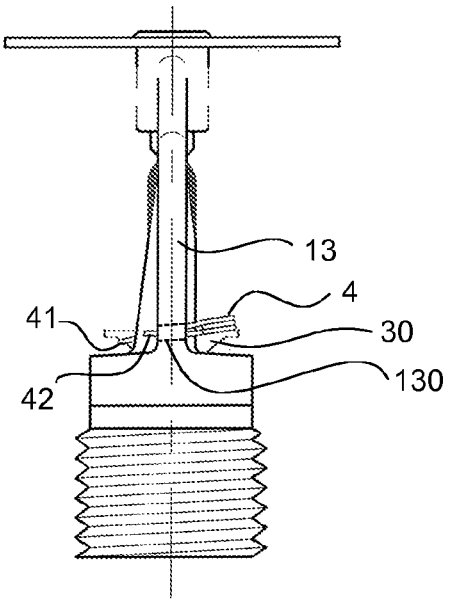
Fig. 3

SPRINKLER COMPRISING A MEMBER HELD BY A FUSIBLE MEMBER AND EJECTION MEANS ACTING IN A PULLING SENSE ON THE MEMBER

CROSS-REFERENCE TO RELATED APPLICATIONS

This Application is a Section 371 National Stage Application of International Application No. PCT/FR2014/050283, filed Feb. 13, 2014, the content of which is incorporated herein by reference in its entirety, and published as WO 2014/128386 A2 on Aug. 28, 2014, not in English.

FIELD OF THE DISCLOSURE

The field of the invention is that of designing and manufacturing firefighting equipment and installations. More precisely, the invention relates to sprinklers particularly designed for "vacuum" firefighting installations.

BACKGROUND OF THE DISCLOSURE

The role of an automatic fire extinguishing installation implementing sprinklers is to detect, as early as possible, the seat of a fire then to automatically trigger the extinction system, at least locally, this while emitting an alarm. The installation has for objective to contain the fire as much as possible, before the arrival of the fire brigade which then takes over the installation in order to extinguish the fire.

In the field of the invention, firefighting installations are classified into three categories, namely:

"wet-pipe" systems;

"dry-pipe" systems;

"vacuum" systems.

In these three systems, the sprinklers are mounted in a network in such a way as to be distributed evenly over the site to be protected. Conventionally, the sprinklers comprise:

- a fixing connector, that allows the sprinkler to be connected to pipework, with this fixing connector having a nozzle intended for the passage of water to be released in order to extinguish the fire;
- a fusible member;
- a shutoff member for shutting off the nozzle, held in the shutoff position by the fusible member.

The fusible member is calibrated to blow when a certain temperature has been exceeded, as such releasing the nozzle from its shutoff member.

In "wet-pipe" systems, the entire piping of the installation is filled with water, and this up to the sprinklers. The water is therefore on standby behind the shutoff means and when the fusible member blows, the water flows through the nozzle of the connector of the sprinkler of which the fusible member has blown.

The release time for the water is therefore immediate, which is particularly advantageous. On the other hand, "wet-pipe" systems, are not adapted for sites that have risks of freezing. Indeed, in case of freezing, the water cannot flow. In addition, the freezing can cause deteriorations to the piping of the installation (deformation and even bursting of the pipes). In certain cases, the installation is emptied of water. In other cases, the site to be protected is heated in order to prevent any risk of freezing. For sites to be protected that have a relatively substantial surface area, the consumption of energy, and consequently the heating bill, can be substantial, and even prohibitive. Another way to fight freezing is to add an antifreeze agent to the water of the installation, such as glycol which is a toxic and carcinogenic product.

In the "dry-pipe" systems, the entire installation is emptied of water. The entire piping of the installation is kept under pressure. When the fusible members blow, the air pressure is released by the sprinkler or sprinklers in question and the water, also under pressure, tends to "push" the air outside of the installation until it arrives at the orifice or orifices released in such a way as to escape through the latter.

With such a system, the water can in certain cases take up to 60 seconds to reach the sprinkler of which the fusible member is blown, which is of course compliant with the current standard but which can be excessively long with regards to certain incipient fires.

In addition, "dry-pipe" systems do not entirely overcome the problems linked to freezing. Indeed, condensation can be created in the piping of a "dry-pipe" installation, which can damage certain components of the installation and cause the protection to fail.

Generally, "wet-pipe" and "dry-pipe" systems have the following disadvantages:

- they are subject to forming slush and, consequently, to clogging;
- they are subject to corrosion, which can obviously lead to an installation partially or entirely out of use and cause the protection to fail;
- they can be the object of water leaks that cannot be seen;
- they allow the development of microorganisms in the pipes of the installation.

This results in that they require, among other things, antifreeze and anticorrosion treatments (involving recourse to harmful products).

Moreover, they require rinsing operations after use.

Furthermore, they imply putting into service times that are relatively long, according to the extent of the installation, which can range from one to four hours for "wet-pipe" systems and two hours and more for the "dry-pipe" systems.

In order to overcome all of these disadvantages, "vacuum" systems were designed. In "vacuum" systems, a vacuum is created in the pipes extending between a general valve and all of the sprinklers. In other terms, all of the pipes separating the valve from the sprinklers are in a vacuum.

In these systems, the vacuum constitutes an active energy which is used as a functional source in monitoring sprinklers. Indeed, if a fusible member of one of the sprinklers blows, the atmospheric pressure reaches the entire installation, which causes a change in the state of an actuator which, in turn, opens the general water inlet valve. Then the water quickly and without any obstacle invades the entire installation until the sprinklers, with the water flowing through the sprinkler or sprinklers of which the fusible member has blown. The vacuum which is still active in the networks quickly attracts the extinguishing water towards the sprinklers of which the fusible member has blown.

The triggering time of the actuator is very short, in that, when a fusible member blows, the "vacuum" installation immediately generates an aspiration phenomenon of the air outside of the installation. Note that this aspiration can be beneficial, as the aspiration effect on the seat of the fire tends to reduce the intensity of the latter.

The time for the water to arrive at the sprinkler of which the fusible member has blown is less than 60 seconds.

It is therefore understood that, due to the absence of water or of condensation in a "vacuum" system installation, the following results are obtained:

no corrosion, therefore no slush forming or clogging;

the guarantee of obtaining the density of extinguishing water required;

no development of microorganisms;

no water leaks possible (as the water is by default absent in the pipes of the installation that lead to the sprinklers);

no need for antifreeze agent or anticorrosion treatment;

no rinsing required before the installation is put into service.

Furthermore, as shall be explained in more detail in what follows, the time for putting an installation with a "vacuum" system into service takes place extremely quickly, under about one minute.

In "vacuum" systems, sprinklers comprise, in addition to the fusible member and shutoff member, means for ejecting the shutoff member.

Indeed, as indicated hereinabove, when a fusible member blows, this results in an aspiration phenomenon of the air towards the inside the pipework of the installation. The shutoff member, if it is not forced to leave its location, remains somewhat "glued" on the mouth of the nozzle of the connector, which then does not allow the air to enter and consequently prevents the actuator from being triggered.

In order to prevent this, means for ejecting are mounted on each sprinkler.

In reference to FIG. 1, a spring R is inserted into a cylindrical part P mounted in the nozzle C of the sprinkler. An end of the spring R is bearing against the bottom of the cylindrical part, while the other spring end is bearing against the shutoff valve O held in position by the fusible member F. The spring R is of course in compressed state.

With such sprinklers, undesirable situations have sometimes been observed.

Indeed, it was observed that after blowing of the fusible member, the shutoff valve can remain in a partial shutoff position of the nozzle of the connector or in a position that hinders the proper distribution of the water. In any case, the spring is not ejected from the nozzle and therefore remain inside the latter.

This results in that, in any case, the nozzle is not entirely released, which forms a partial obstacle to the intake of air in the network. The consequence is that the vacuum of the installation is slowed down and, consequently, the triggering of the actuator is delayed, which can reach 30 to 40 seconds.

Although this situation is not very frequent, when it occurs, it can double the reaction time of the actuator.

Moreover, with the sprinklers designed such as shown in FIG. 1, the spring is, as described previously, mounted in the nozzle of the connector. This spring is therefore entirely hidden inside the sprinkler. However, in "wet-pipe" or "dry-pipe" systems, the sprinklers have exactly the same outside appearance but do not integrate the ejection spring. It is therefore possible for an installer to mount a sprinkler that does integrate a spring, therefore intended for a "wet-pipe" and "dry-pipe" system, on a "vacuum" system. Such a confusion can result in serious consequences, since a sprinkler that does not integrate a spring mounted on a "vacuum" system will remain closed even in the case where the fusible member blows (the shutoff member being drawn by the connector mounted on the vacuum pipework).

SUMMARY

An exemplary embodiment of the present application relates to a sprinkler for a vacuum network of the type comprising:

a fixing connector, that allows the sprinkler to be connected to pipework, having a nozzle;

a fusible member;

a shutoff member for shutting off the nozzle, held in the shutoff position by the fusible member;

means for ejecting the shutoff member.

According to the invention, the sprinkler is characterised in that said means of ejecting are mounted outside the nozzle and act in a pulling sense on the shutoff member, with said means of ejecting comprising at least one torsion spring having a winding from which extend two limbs, of which one limb which cooperates with the shutoff member, with the sprinkler comprising a means for retaining the other limb which has a proximal portion, at the output of the winding, and a terminal portion, with the two portions forming an elbow.

As such, thanks to the invention, after the blowing of the fusible member of a sprinkler, the complete release of the nozzle of the sprinkler is obtained.

Indeed, two characteristics of the invention are combined in order to obtain this particular advantageous result, namely:

the fact that the spring is mounted outside the nozzle, and therefore is not in a position to hinder the intake of air into the pipework of the installation;

the spring acts in a pulling sense on the shutoff member, which provides for its extraction and its ejection from the sprinkler.

This results in that the vacuum is not in any case slowed down with a sprinkler according to the invention and in that, consequently, the triggering and the release of water with a "vacuum" system is of the most reactive in all circumstances. For the purposes of information, the triggering time is about 5 seconds.

Moreover, note that, as the spring is mounted outside the nozzle, it can be seen on the sprinkler. This results in that it is not possible to confuse a sprinkler intended for a "vacuum" system with a sprinkler intended for another system. Indeed, the user can identify a sprinkler intended for the "vacuum" system simply by the presence, which can be seen, of the spring.

Note that the principle of the invention can be applied, as it shall appear more clearly in what follows, to "standing" sprinklers (installed on pipework with the connector at the bottom), as well as to so-called "hanging" sprinklers (with which the connector is mounted on a pipework at the top position). The invention can also be used on dry type pendent sprinklers, used for example for passing through the ceilings of cold rooms.

Note in addition that the implementing of a such a torsion spring makes it possible to effectively achieve the desired result, by having the advantage of being able to be mounted easily in a small space.

Furthermore, the elbow shape of one of the limbs of the spring confers to the spring a particular capacity such that, when switching from the tensioned state to the untensioned state, the limb acting on the shutoff member will be subjected to a movement that tends to increase the ejection effect, by imparting a force on the shutoff member that clearly comprises a component directed upwards, combined with a lateral force that provides for the ejection outside of the space delimited by the yoke of the sprinkler.

According to a first approach that can be considered, the means for retaining is presented by a yoke.

According to a first embodiment applied to a sprinkler of the "standing" type, the shutoff member has, outside the nozzle a flared flange, with a limb of the torsion spring being placed under the flange.

In this case, said limb of the torsion spring placed under the flange is curved in such a way as to hug the shape of the flange.

A reliable action of the spring on the flange of the shutoff member is provided in this way, for the purpose of obtaining the ejection thereof with certainty.

According to an embodiment in which the sprinkler comprises a deflector borne by a yoke, a limb of the spring is advantageously inserted into an orifice arranged in the yoke.

The mounting of the torsion spring on the sprinkler can, according to this characteristic, be carried out rapidly without tools, as shall be explained in more detail in what follows.

According to a second embodiment applied to a sprinkler of the "hanging" type, the shutoff member has, outside the nozzle, a means for hooking, with a limb of the torsion spring having at its end a hook intended to cooperate with said means for hooking.

In this case, a limb of the spring is preferentially inserted into an orifice arranged in the fixing connector, said orifice extending advantageously, in mounting position of the sprinkler, according to a vertical or near-vertical direction, exiting downwards.

With such a design of the sprinkler and such a mounting of the torsion spring on the sprinkler, the spring will not only impart an ejection force on the shutoff member but will, as shall be explained in more detail in what follows, also be ejected from itself from the sprinkler.

BRIEF DESCRIPTION OF THE DRAWINGS

Other characteristics and advantages of the invention shall appear more clearly when reading the following description of two preferred embodiments of the invention, given by way of simple examples for the purposes of information and non-restricted, and of the annexed drawings among which:

FIG. 1 diagrammatically shows as a cross-section a sprinkler according to prior art;

FIGS. 2 and 3 diagrammatically show a sprinkler according to a first embodiment of the invention, respectively as a cross-section view and as a side view;

DETAILED DESCRIPTION OF ILLUSTRATIVE EMBODIMENTS

Figure 4:
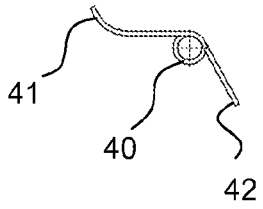
FIGS. 4 to 6 diagrammatically show a torsion spring intended to be provided on a sprinkler according to the first embodiment, respectively viewed from above in untensioned state, viewed from above in tensioned state and viewed from the side.

According to the first embodiment of the invention shown in FIGS. 2 and 3, the sprinkler is a "standing" sprinkler comprising:

- a fixing connector 1, presenting an external thread making it possible to screw the latter on a pipework having a complementary thread, for the purpose of connecting the sprinkler to the pipework, with the connector having a nozzle 10 intended to communicate with the inside of the pipework;
- a fusible member 2, constituted in practice by an ampoule enclosing a liquid and an air bubble provided, according to the conventional technique of fusible members used on sprinklers, to expand and cause the bursting of the ampoule if the temperature to which the fusible member is subjected exceeds a predetermined threshold;
- a shutoff member 3 for shutting off the nozzle 10;
- a deflector 12 fixed on a yoke 13 made integral with the connector 1 of the sprinkler.

The fusible member 2 bears, by one of its ends, on the shutoff member 3 in such a way as to maintain the nozzle in its shutting-off position, with the other end of the fusible member bearing against a lug 20 integral with the yoke and, here, with the deflector 12 (with the lug 20 being in practice also a means of fastening by screwing of the deflector on the yoke).

According to the principle of the invention, the sprinkler further comprises means for ejecting mounted outside the nozzle 10 and acting in a pulling sense on the shutoff member 3. Of course, as long as the fusible member 2 is in place, the latter exerts a force that is greater than the force of the pulling of the means for ejecting.

Figure 5:
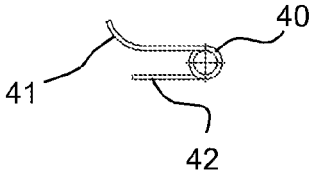
Figure 6:
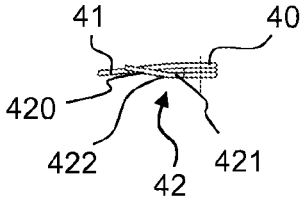

The means for ejecting are constituted of a spring, and more precisely a torsion spring 4, such as shown in FIGS. 4 to 6.

Such as shown in these figures, the spring 4 comprises:

- a winding 40, of one or several coils;
- a first limb 41 extending from the winding 40, and intended to cooperate with the shutoff member;
- a second limb extending from the winding 40, and intended to be retained on the sprinkler.

In other terms, the torsion spring 4 has a winding 40 from which extends a limb 41 which cooperates with the shutoff member 3, with the sprinkler comprising a means for retaining the other limb 42 which extends from the winding, with this other limb being elbowed in a particular manner in order to generate a kinematics for ejecting that combines two components, one according to the longitudinal axis of the sprinkler et the other forming a non-zero angle with the longitudinal axis of the sprinkler.

In untensioned state, the spring 4 has a configuration wherein the limbs 41 and 42 are separated from one another, such as shown in FIG. 4, while, in tensioned state, the two limbs 41 and 42 are brought closer to one another, such as shown in FIG. 5. In tensioned state, according to the operating principle of a torsion spring, the limbs 41 and 42 tend to exert a force on the elements that retain them in this position, in order to return to their respective positions that correspond to the untensioned state, such as shown in FIG. 4 in untensioned state.

Such a spring is therefore intended to cooperate via one of its limbs (here limb 41) with the shutoff member for the purpose of ejecting the latter from the sprinkler after the blowing of the fusible member 2.

According to this embodiment, the shutoff member 3 has a flange 30 extending outside the nozzle 10 and having a flared shape.

The shutoff member 3 is kept bearing against a washer 11 mounted at the end of the nozzle 10. The flared flange 30 of the shutoff member arranges a space 110 with the washer 11.

The spring 4 is mounted on the sprinkler in such a way that one of its limbs (here the limb 41) is placed in the space 110, i.e. between the flared flange 30 and the washer 11 of the sprinkler. More precisely, the space 110 between the flange 30 and the washer 11 is provided in such a way that the corresponding limb of the spring is caught in this space once the fusible member is installed. The spring is therefore kept in complete safety in standby position.

In addition, such as shown in FIGS. 4 and 5, the limb 41 has a curved shape provided to hug the shape of the flange, with the latter having a section of circular shape. As such, it is specified that the washer 11 has a passage of circular shape and that the body 31 of the shutoff member 3 is introduced into the passage of the washer, extending therefore inside the nozzle 10, until the washer with a flanged, and more precisely tapered, shape, bears against the edges of the passage of the washer, shutting off the latter.

The limb 41 of the spring 4 is therefore inserted into the space 110 between the flange 30 and the washer 11, while the other limb 42 of the spring 4 is kept in a means for retaining that is present, according to this embodiment, on the connector, positioned in such a way that the spring takes of course its tensioned configuration such as shown in FIG. 5.

According to this embodiment, this means for retaining takes the form of an orifice 130 arranged at the base of the yoke 13, and intended to be passed through by the limb 42 such as shown in FIG. 3.

Moreover, according to a characteristic of the spring 4 of this embodiment, the limb 42, intended to be inserted into the orifice 130 arranged at the base of the yoke, has two portions, namely:

- a proximal portion 421, at the output of the winding;
- a terminal portion 420, intended to be inserted into the orifice 130 at the base of the yoke, and to pass through the latter.

Such as shown in FIG. 6, the two portions form an elbow in such a way that the terminal portion is able to rise back through the orifice 130 of the yoke, this with respect to the proximal portion (according to the position of the height of the winding with respect to the orifice, it can also be considered that the proximal portion descend with respect to the distal portion once the latter is inserted into the orifice).

The mounting and the operation of a sprinkler according to this first embodiment is described hereinafter.

For the mounting of such a sprinkler, the shutoff member 3 is set up on the washer 11, then the fusible member is installed bearing against the shutoff member. As long as the fusible member is maintained bearing against the shutoff member, the deflector 12 is installed, then the lug 20 is screwed, in such a way that the whole is rigidly maintained.

The spring 4 is then installed. For this, the limb 41 is for example slid under the flange 30, in the space 110 between the latter and the washer 11. Then, the spring 4 is tensioned, by bringing the limb 42 closer to the limb 41, until able to insert the end of the limb 42 into the orifice 130 of the base of the yoke 13 of the sprinkler. The engagement of the limb 42 into the orifice is continued until the latter passes through the orifice.

In the case of the blowing of the fusible member 2, the latter no longer exerts any force on the shutoff member in such a way as to retain the latter. The spring 4 can therefore switch from its tensioned position, such as shown in FIG. 5, to its untensioned position, such as shown in FIG. 4. The separation of the limb 41 with respect to the limb 42 (which remains at least temporarily inserted in the orifice 130) favours the ejection of the shutoff member. This ejection takes place via a force imparted from the bottom upwards of the limb 42 on the shutoff member 3, by exerting a thrust under the flange 30. The elbow shape of the limb 42 combined with the passage of the spring 4 from the tensioned position to the untensioned position generates a movement of the limb 41 which goes from the bottom upwards in such a way as to pull the shutoff member 3 outside of the seat constituted of the washer 11.

Figure 7:
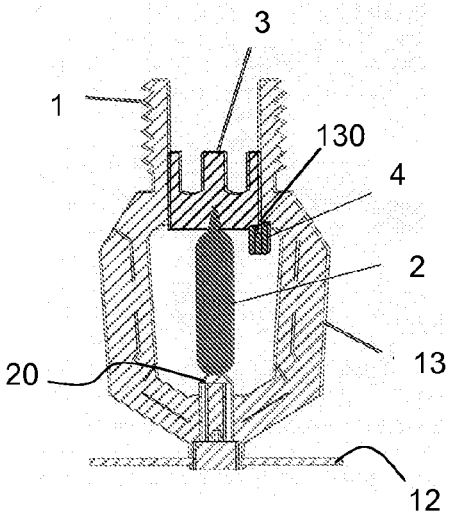
FIGS. 7 and 8 diagrammatically show a sprinkler according to a second embodiment of the invention, respectively before and after the blowing of the fusible member.
Figure 8:
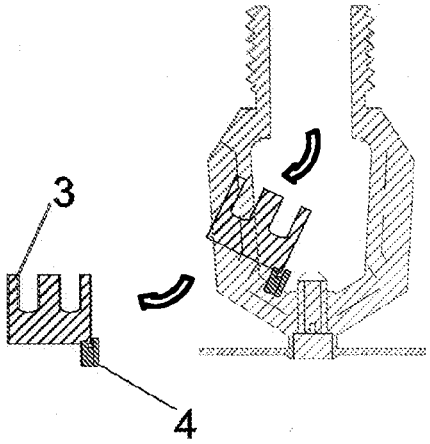

FIGS. 7 and 8 show a second embodiment of the invention.

This second embodiment corresponds to an application of the invention to "hanging" sprinklers, i.e. sprinklers with which the connector 1 is screwed and installed on a pipework while it is in top position with respect to the rest of the sprinkler.

Similar to the first embodiment, the sprinkler of this second embodiment comprises:

- a fixing connector 1, that allows the sprinkler to be connected to pipework, having a nozzle through which the water is intended to flow in case of a blowing of the sprinkler;
- a fusible member 2;
- a shutoff member 3 for shutting off the nozzle, held in shutoff position by the fusible member 2;
- a deflector 12 connected to the connector by a yoke 13 made integral with the connector.

According to the principle of the invention, this second embodiment of a sprinkler according to the invention also implements means for ejecting mounted outside the nozzle and acting in a pulling sense on the shutoff member 3, with these means for ejecting being constituted by a spring of the same type as that previously, namely comprising:

- a winding 40, of one or several coils;
- a first limb 41 extending from the winding 40, and intended to cooperate with the shutoff member;
- a second elbowed limb 42 extending from the winding 40, and intended to be retained on the sprinkler.

In a manner similar to the first embodiment, the spring 4 therefore has two limbs connected by a winding, with one limb of the spring being inserted into a means for retaining the sprinkler, here, in an orifice arranged in the fixing connector, while the other limb is intended to cooperate with the shutoff member and has for this purpose at its end a hook intended to cooperate with a means of hooking that is present, outside the nozzle on the shutoff member.

According to this embodiment, the orifice receiving the limb of the spring 4 extends along a vertical or near-vertical direction, exiting downwards.

The mounting and the operation of a sprinkler according to this second embodiment is described hereinafter.

The shutoff member 3, the fusible member 2, the lug 20 and the deflector 12 are installed on the sprinkler in a manner similar to that already described in reference to the first embodiment.

The spring 4 is then installed for example by hooking one of the limbs of the spring by means of hooking provided for this purpose on the shutoff member 3, then by tensioning the spring until able to insert the other limb into the orifice of the connector. The spring 4 is then in its tensioned position, and holds itself in position (with the winding of the spring extending freely under the limbs), under the simple effect of the limbs that seek to separate from one another.

After blowing of the fusible member 2, and therefore in the absence of any force for maintaining the shutoff member 3 in position, the spring 4 switches from its tensioned configuration to its untensioned configuration. In a first step, a limb of the spring remains inserted in the orifice corresponding to the connector and the other limb of the spring imparts an ejection movement on the shutoff member 3. Rapidly after the ejection of the shutoff member 3, the spring is ejected from itself, via simple gravity, with the limb of the spring being removed freely from the orifice of the connector.

Note that a sprinkler according to one of the two embodiments that have just been described, can be mounted at the base of a dry type pendent sprinkler, provided to extend for example through of ceiling of a cold room.

An exemplary embodiment of the present disclosure proposes a sprinkler that allows for a complete release of the nozzle from the connector in the case where the fusible member blows.

An exemplary embodiment guarantees in all circumstances a minimum triggering time of the actuator of a "vacuum" system.

An exemplary embodiment proposes such a sprinkler that prevents any confusion with sprinklers for "wet-pipe" or "dry-pipe" system.

Although the present disclosure has been described with reference to one or more examples, workers skilled in the art will recognize that changes may be made in form and detail without departing from the scope of the disclosure and/or the appended claims.

The invention claimed is:

1. A sprinkler for a vacuum network, comprising:

a fixing connector, which allows the sprinkler to be connected to pipework and has a nozzle;

a fusible member;

a shutoff member for shutting off the nozzle, held in shutoff position by the fusible member;

an ejecting element configured to eject the shutoff member, wherein the ejecting element is mounted outside the nozzle, acts in a pulling sense on the shutoff member, and comprises at least one torsion spring having a winding from which extend two limbs, of which one limb cooperates with the shutoff member;

a retainer, which comprises a yoke and wherein the other limb of the spring is inserted into an orifice arranged in the yoke, the other limb comprising a proximal portion, at the output of the winding, and a terminal portion, with the two portions forming an elbow; and a deflector borne by the yoke.

2. The sprinkler according to claim 1, wherein the sprinkler is of a standing type of sprinkler, wherein the shutoff member has, outside the nozzle, a flared flange, with the limb of the torsion spring that cooperates with the shutoff member being placed under the flange.

3. The sprinkler according to claim 2, wherein said limb of the torsion spring placed under the flange is curved in such a way as to hug the shape of the flange.

4. The sprinkler according to claim 1, wherein the terminal portion rises back through the orifice with respect to the proximal portion.

5. The sprinkler according to claim 1, wherein the sprinkler is of a hanging type of sprinkler, wherein the shutoff member has, outside the nozzle, a means for hooking, with a limb of the torsion spring having at its end a hook that cooperates with said means for hooking.

* * * * *